US010526687B2

(12) United States Patent
Shibata et al.

(10) Patent No.: US 10,526,687 B2
(45) Date of Patent: Jan. 7, 2020

(54) ULTRA-HIGH-STRENGTH STEEL SHEET HAVING EXCELLENT DELAYED FRACTURE RESISTANCE AT CUT END THEREOF

(71) Applicant: KOBE STEEL, LTD., Kobe-shi (JP)

(72) Inventors: Kosuke Shibata, Hyogo (JP); Toshiya Nakata, Hyogo (JP); Toshio Murakami, Hyogo (JP); Takahiro Ozawa, Hyogo (JP); Fumio Yuse, Hyogo (JP); Atsuhiro Shiraki, Hyogo (JP); Kenji Saito, Hyogo (JP); Yukihiro Utsumi, Hyogo (JP)

(73) Assignee: KOBE STEEL, LTD., Kobe-shi (JP)

( * ) Notice: Subject to any disclaimer, the term of this patent is extended or adjusted under 35 U.S.C. 154(b) by 196 days.

(21) Appl. No.: 15/550,223

(22) PCT Filed: Feb. 8, 2016

(86) PCT No.: PCT/JP2016/053646
§ 371 (c)(1),
(2) Date: Aug. 10, 2017

(87) PCT Pub. No.: WO2016/129550
PCT Pub. Date: Aug. 18, 2016

(65) Prior Publication Data

US 2019/0153575 A1 May 23, 2019

(30) Foreign Application Priority Data

Feb. 13, 2015 (JP) ..... 2015-026735
Jul. 27, 2015 (JP) ..... 2015-147463

(51) Int. Cl.
*C22C 38/58* (2006.01)
*C22C 38/06* (2006.01)
*C21D 9/46* (2006.01)

(52) U.S. Cl.
CPC ..... *C22C 38/58* (2013.01); *C22C 38/06* (2013.01); *C21D 9/46* (2013.01); *C21D 2211/008* (2013.01)

(58) Field of Classification Search
CPC ..... C21D 9/46; C21D 6/001; C21D 6/002; C21D 6/005; C21D 6/008; C21D 8/0205;
(Continued)

(56) References Cited

U.S. PATENT DOCUMENTS

2001/0015245 A1 8/2001 Eberle et al.
2011/0048589 A1* 3/2011 Matsuda ..... C21D 1/18 148/645

(Continued)

FOREIGN PATENT DOCUMENTS

CN 101835917 A 9/2010
JP 2007-231373 A 9/2007

(Continued)

OTHER PUBLICATIONS

International Search Report dated Mar. 22, 2016 in PCT/JP2016/053646 (with English translation).

(Continued)

*Primary Examiner* — Anthony J Zimmer
*Assistant Examiner* — Ricardo D Morales
(74) *Attorney, Agent, or Firm* — Oblon, McClelland, Maier & Neustadt, L.L.P.

(57) ABSTRACT

Provided is an ultra-high-strength steel sheet having a component composition that includes specific amounts of each of C, Mn, and Al and a remainder of iron and unavoidable impurities, and in which the amounts of each of P, S, and N among the unavoidable impurities are limited to a specific amount. The ultra-high-strength steel sheet includes 2 area% or more of a region having a structure that includes 90% or more of martensite and 0.5% or more of residual austentite (Continued)

Schematic View of Shear Cutting by area ratio relative to the entire structure, the local Mn concentration in said region being at least 1.1 times that of the Mn content of the entire steel sheet. The ultra-high-strength steel sheet has a tensile strength of 1470 MPa or more.

6 Claims, 1 Drawing Sheet

(58) Field of Classification Search
CPC ..... C21D 8/0226; C21D 2211/002; C21D 2211/008; C21D 2211/009; C22C 38/00; C22C 38/002; C22C 38/02; C22C 38/04; C22C 38/06; C22C 38/08; C22C 38/12; C22C 38/14; C22C 38/18; C22C 38/54
See application file for complete search history.

(56) References Cited

U.S. PATENT DOCUMENTS

2011/0253271 A1* 10/2011 Kumagai ..... B66C 23/62 148/645
2013/0295402 A1 11/2013 Oh et al.
2013/0330226 A1 12/2013 Murakami et al.
2014/0205855 A1* 7/2014 Kawata ..... C23C 2/02 428/632

FOREIGN PATENT DOCUMENTS

| | | | |
|---|---|---|---|
| JP | 2008-56991 | A | 3/2008 |
| JP | 2008-81788 | A | 4/2008 |
| JP | 2010-215958 | A | 9/2010 |
| JP | 2012-180570 | A | 9/2012 |
| KR | 10-2010-0116608 | A | 11/2010 |
| KR | 10-2012-0073407 | A | 7/2012 |
| WO | WO 2013/018740 | A1 | 2/2013 |

OTHER PUBLICATIONS

Written Opinion of the International Searching Authority dated Mar. 22, 2016 in PCT/JP2016/053646 (with English translation).

* cited by examiner

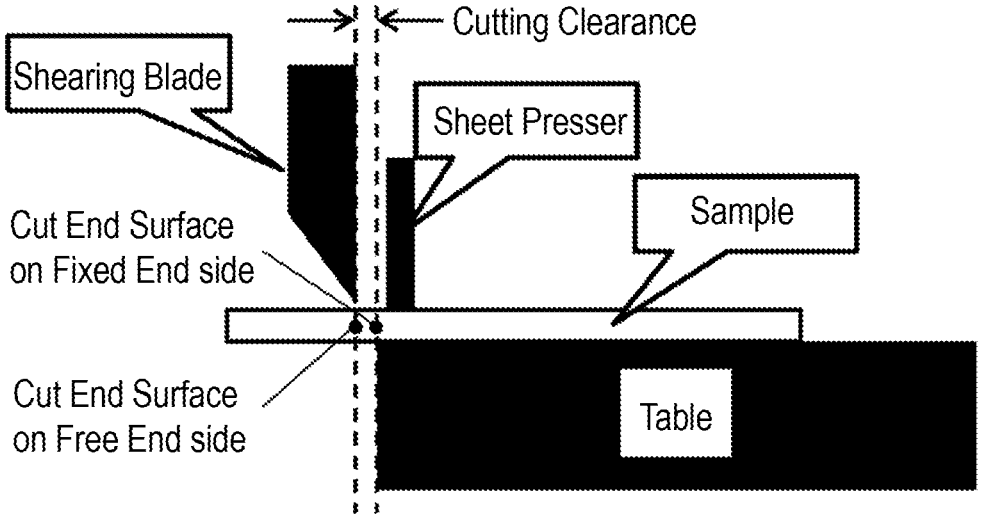
Schematic View of Shear Cutting

ULTRA-HIGH-STRENGTH STEEL SHEET HAVING EXCELLENT DELAYED FRACTURE RESISTANCE AT CUT END THEREOF

TECHNICAL FIELD

The present invention relates to an ultra-high-strength steel sheet excellent in resistance to delayed fracture at a cut end thereof. The steel sheet type of the ultra-high-strength steel sheet in accordance with the present invention shall be considered to include not only cold-rolled steel sheets, but also various plated steel sheets such as hot-dip galvanized steel sheets and hot-dip galvanized and alloyed steel sheets.

BACKGROUND ART

In order to achieve both weight reduction and collision safety of automobiles, steel materials used for skeleton components have recently been required to be increased in strength.

However, in adoption of high-strength steel sheets, there is a concern of delayed fracture, which causes a hindrance to increasing the strength of the steel sheets for automobiles. The delayed fracture is a phenomenon that steel suffers brittle fracture after the elapse of a predetermined time in a state where a static load is applied, and is considered to be caused by hydrogen intruded into the steel. It has also been reported that when plastic strain is introduced into a steel sheet, delayed fracture is enhanced. Since large plastic strain is introduced into a cut end formed by shearing of a thin steel sheet, properties thereof are inferior, and the delayed fracture is considered to be liable to occur at the cut end in the thin steel sheet. When the delayed fracture occurs at the cut end in actual use environment to grow to a large crack, the member strength is degraded, which may lead to a serious accident.

It has therefore been eagerly desired to provide a steel sheet that has a high strength and is excellent in resistance to delayed fracture at a cut end thereof. More specifically, a steel sheet having a tensile strength of 1470 MPa or more and excellent resistance to delayed fracture at the cut end under actual environment has been required.

Conventionally, in order to increase the resistance to delayed fracture of high-strength steel sheets, many techniques using hydrogen trap sites have been proposed.

For example, Patent Literature 1 discloses a technique of increasing hydrogen trapping ability by dispersing an oxide in a steel sheet surface layer or a plated layer of a plated steel sheet, for the purpose of improving the resistance to delayed fracture at a welded part.

Further, Patent Literature 2 discloses a technique of utilizing a V-based carbide or the like as hydrogen trap sites, for the purpose of improving the resistance to delayed fracture after molding.

However, since the cut end of the steel sheet is a part to which extremely large deformation is added, the trap sites which trap hydrogen in an interface with a matrix, such as the oxides and carbides proposed in Patent literatures 1 and 2 described above, are changed in an interface structure by the large deformation to cause a problem that it becomes impossible to exhibit sufficient hydrogen trapping ability after cutting.

In addition, Patent Literature 3 discloses a technique of utilizing lath-shaped residual austenite as the hydrogen trap sites, for the purpose of improving the resistance to delayed fracture in punched parts.

Since residual austenite traps hydrogen in the inside thereof, even when the interface structure is changed with deformation caused by cutting, the hydrogen trapping activity is not lost thereby. However, since ordinary residual austenite is transformed to martensite by strain induced transformation when large deformation is added thereto, there is a problem that the hydrogen trapping ability is also degraded at the cut end with the large deformation.

CITATION LIST

Patent Literatures

Patent Literature 1: JP-A-2007-231373
Patent Literature 2: JP-A-2008-56991
Patent Literature 3: JP-A-2008-81788

SUMMARY OF INVENTION

Technical Problems

Therefore, an object of the present invention is to provide an ultra-high-strength steel sheet having a tensile strength of 1470 MPa or more, which can exhibit excellent resistance to delayed fracture also at a cut end thereof.

Solution to Problems

In a first invention of the present invention which is an ultra-high-strength steel sheet excellent in resistance to delayed fracture at a cut end thereof, the ultra-high-strength steel sheet has a composition comprising, by mass %, C: 0.15% to 0.4%,
Mn: 0.5% to 3.0%,
Al: 0.001% to 0.10% and
the balance being iron and inevitable impurities, wherein each of P, S and N of the inevitable impurities is limited to P: 0.1% or less
S: 0.01% or less and
N: 0.01% or less, the ultra-high-strength steel sheet has a structure comprising, by area ratio based on a whole structure, martensite: 90% or more and
residual austenite: 0.5% or more, the ultra-high-strength steel sheet has 2% or more by area ratio of a region where a local Mn concentration is at least 1.1 times a Mn content in a whole steel sheet, and the ultra-high-strength steel sheet has a tensile strength of 1470 MPa or more.

In a second invention of the present invention which is the ultra-high-strength steel sheet excellent in resistance to delayed fracture at a cut end thereof according to the first invention, the composition further comprises, by mass%, Si: 0.1% to 3.0%.

In a third invention of the present invention which is the ultra-high-strength steel sheet excellent in resistance to delayed fracture at a cut end thereof according to the first or second invention, the composition further comprises, by mass %, one or two or more of Cu: 0.05% to 1.0%,
Ni: 0.05% to 1.0% and
B: 0.0002% to 0.0050%.

In a fourth invention of the present invention which is the ultra-high-strength steel sheet excellent in resistance to delayed fracture at a cut end thereof according to any one of the first to third inventions, the composition further comprises, by mass %, one or two or more of Mo: 0.01% to 1.0%, Cr: 0.01% to 1.0%, Nb: 0.01% to 0.3%, Ti: 0.01% to 0.3% and V: 0.01% to 0.3%.

In a fifth invention of the present invention which is the ultra-high-strength steel sheet excellent in resistance to delayed fracture at a cut end thereof according to any one of the first to fourth inventions, the composition further comprises, by mass %, one or two of Ca: 0.0005% to 0.01% and Mg: 0.0005% to 0.01%.

Advantageous Effects of Invention

In accordance with the present invention, martensite is used as a main structure of steel and Mn is concentrated in residual austenite to maintain hydrogen trapping ability at the cut part, even after cutting of a steel sheet, whereby it has become possible to provide an ultra-high-strength steel sheet excellent in resistance to delayed fracture at the cut end.

BRIEF DESCRIPTION OF DRAWING

FIG. 1 is a view schematically showing a state of shear cutting in Examples.

DESCRIPTION OF EMBODIMENTS

The present invention will be explained below in greater detail.

First, a structure characterizing an ultra-high-strength steel sheet excellent in resistance to delayed fracture at a cut end thereof in accordance with the present invention (hereinafter also referred to as "the steel sheet in the present invention") will be explained.

[Structure of the Steel Sheet in the Present Invention]

As described above, in the steel sheet in the present invention, martensite is used as a matrix, and moreover residual austenite in which Mn is concentrated is contained in a predetermined amount (hereinafter, austenite is sometimes represented by γ).

<Martensite: 90% or More>

In order to realize the steel sheet having a tensile strength of 1470 MPa or more, martensite is required to be, by area ratio, 90% or more, preferably 92% or more, and more preferably 94% or more. In the present description, martensite is used to mean including both fresh martensite not subjected to tempering and tempered martensite subjected to tempering.

Since all except for residual austenite may be martensite, the upper limit of the martensite area ratio is 99.5%, and it is preferably 99% or less, in consideration of the lower limit (0.5%) of residual austenite.

<Residual Austenite: 0.5% or More>

In order to make residual austenite function as sufficient hydrogen trap sites, it is required to be, by area ratio, 0.5% or more, preferably 0.6% or more, and more preferably 0.7% or more.

Since all except for martensite may be residual austenite, the upper limit of the residual austenite area ratio is 10%, and it is preferably 5% or less, more preferably 3% or less, and particularly preferably 2% or less, in consideration of the lower limit (90%) of martensite.

As described above, although the steel sheet in the present invention may be composed of only two phases of martensite and residual austenite (the total area ratio of the two phases is 100%), it is possible to inevitably generate other phases (such as ferrite, bainite and pearlite). The presence of such other phases is allowed as long as the total area ratio thereof is 9.5% or less. The total area ratio of the other phases is preferably 7.5% or less, and more preferably 5.5% or less.

<Region where the Local Mn Concentration is at Least 1.1 Times the Mn Content in the Whole Steel Sheet: 2% or More by Area Ratio>

As described above, the cut end of the steel sheet is a part to which extremely large deformation is added. The trap sites which trap hydrogen in the interface with the matrix, such as the oxides and carbides proposed in the above-mentioned background art, are changed in the interface structure by the large deformation, and it is impossible to exhibit sufficient hydrogen trapping ability after cutting.

By contrast, since residual austenite traps hydrogen in the inside thereof, even when the interface structure is changed by deformation with cutting, the hydrogen trapping activity is not lost thereby. Accordingly, the resistance to delayed fracture at the cut end can be increased by dispersing in the matrix extremely stable residual austenite which is not transformed to martensite by strain induced transformation even when large deformation is added thereto.

Therefore, in order to increase the stability of residual austenite, it is considered to increase the Mn concentration in residual austenite. On the other hand, however, Mn degrades weldability of the steel sheet to promote segregation of P in the steel and have an action of degrading the resistance to delayed fracture, and there is the upper limit in the content thereof.

As a solution thereof, in the steel sheet in the present invention, a Mn-concentrated region is formed in the steel sheet. That is, residual austenite formed in the Mn-concentrated region is stabilized while keeping low the Mn concentration in the matrix. This results in that a part of a region where the local Mn concentration is at least 1.1 times the Mn content in the whole steel sheet is present as residual austenite to contribute to improvement of the resistance to delayed fracture at the cut end.

Since residual austenite formed in the steel sheet in the present invention is extremely fine, the Mn concentration cannot be directly measured. Therefore, by the presence of the region where the local Mn concentration is at least 1.1 times the Mn content in the whole steel sheet at an area ratio of 2% or more (preferably 2.5% or more, and more preferably 3% or more), it is ensured that Mn is sufficiently concentrated in residual austenite.

Then, the composition constituting the steel sheet in the present invention will be explained. All the units of chemical components are hereinafter by mass %.

[Composition of Steel Sheet in the Present Invention]

C: 0.15% to 0.4%

C is an important element having a large influence on the strength of the steel sheet. In order to secure the strength of the steel sheet, C is contained in an amount of 0.15% or more, preferably 0.16% or more and more preferably 0.17% or more. However, when C is excessively contained, the weldability is degraded. Therefore, C is contained in an amount of 0.4% or less, preferably 0.35% or less, and more preferably 0.3% or less.

Mn: 0.5% to 3.0%

Mn is a useful element contributing to an increase in the strength of the steel sheet as a solid solution hardening element. It has also an effect of suppressing ferrite transformation during cooling by increasing hardenability during quenching. In addition, since it has also an effect of stabilizing austenite, residual austenite having high stability can be formed. In order to effectively exhibit such actions, Mn is contained in an amount of 0.5% or more, preferably 0.7% or more, and more preferably 0.9% or more. However, when Mn is excessively contained, the segregation of P to grain boundary is promoted to significantly degrade the resistance to delayed fracture. Therefore, Mn is contained in an amount of 3.0% or less, preferably 2.5% or less, and more preferably 2.0% or less.

Al: 0.001% to 0.10%

Al is a useful element added as a deoxidizing agent, and in order to obtain such an action, it is contained in an amount of 0.001% or more, preferably 0.01% or more, and more preferably 0.03% or more. However, when Al is excessively contained, cleanliness of the steel is degraded. Therefore, Al is contained in an amount of 0.10% or less, preferably 0.08% or less, and more preferably 0.06% or less.

The steel sheet in the present invention contains the above-mentioned elements as essential elements, the balance being iron and inevitable impurities (such as P, S, N and O). Of the inevitable impurities, P, S and N can be contained up to respective allowable ranges as described below.

P: 0.1% or Less

P is inevitably present as an impurity element, and contributes to an increase in the strength by solid solution hardening. However, the segregation thereof to prior austenite grain boundary embrittles the grain boundary, thereby degrading processability. Therefore, the P amount is limited to 0.1% or less, preferably 0.05% or less, and more preferably 0.03% or less.

S: 0.01% or Less

S is also inevitably present as an impurity element, and forms MnS inclusions, which may be starting points of cracks during deformation, thereby decreasing the processability. Therefore, the S amount is limited to 0.01% or less, preferably 0.005% or less, and more preferably 0.003% or less.

N: 0.01% or Less

N is also inevitably present as an impurity element, and decreases the processability of the steel sheet by strain aging. Therefore, the N amount is limited to 0.01% or less, preferably 0.005% or less, and more preferably 0.003% or less.

In addition to these, the following allowable components may be contained within the ranges not impairing the actions of the present invention.

Si: 0.1% to 3.0%

Si is a useful element contributing to an increase in the strength of the steel sheet as a solid solution hardening element. In order to obtain such an action, Si is preferably contained in an amount of 0.1% or more, further 0.3% or more, and particularly 0.5% or more. However, when Si is excessively contained, the weldability is remarkably degraded. Therefore, Si is contained in an amount of 3.0% or less, preferably 2.5% or less, and more preferably 2.0% or less.

One or two or more of

Cu: 0.05% to 1.0%,

Ni: 0.05% to 1.0% and

B: 0.0002% to 0.0050%

These elements are useful elements having an effect of increasing hardenability during quenching and suppressing transformation from austenite. In order to obtain such an action, the respective elements are preferably contained in an amount equal to or more than the above-mentioned lower limits, respectively. The above-mentioned elements may be contained either alone or as a combination of two or more thereof. However, even when these elements are excessively contained, the effect becomes saturated, resulting in an economic waste. Therefore, the respective elements are contained in an amount equal to or less than the above-mentioned upper limits, respectively.

One or two or more of

Mo: 0.01% to 1.0%,

Cr: 0.01% to 1.0%,

Nb: 0.01% to 0.3%,

Ti: 0.01% to 0.3% and

V: 0.01% to 0.3%

These elements are useful for improving the strength without degrading the processability. In order to obtain such an action, the respective elements are preferably contained in an amount equal to or more than the above-mentioned lower limits, respectively. The above-mentioned elements may be contained either alone or as a combination of two or more thereof However, when these elements are excessively contained, coarse carbides are formed to degrade the processability. Therefore, the respective elements are contained in an amount equal to or less than the above-mentioned upper limits, respectively.

One or two of

Ca: 0.0005% to 0.01% and

Mg: 0.0005% to 0.01%

These elements are useful for improving the processability by decreasing starting points of fracture by refining inclusions. In order to obtain such an action, the elements are each preferably contained in an amount of 0.0005% or more. The above-mentioned elements may be contained either alone or as a combination of two of them. However, when excessively contained, the inclusions are coarsened on the contrary to degrade the processability. Therefore, the elements are each contained in an amount of 0.01% or less.

Then, preferred production conditions for obtaining the above-mentioned steel sheet in the present invention will be explained below.

[Preferred Production Method of Steel Sheet in the Present Invention]

First, the steel having the above-mentioned composition is melted, and a slab (steel material) is obtained by ingot making or continuous casting. Thereafter, hot rolling is performed under conditions of a soaking temperature of 1200° C. or lower (more preferably 1150° C. or lower) and a finishing temperature of 900° C. or lower (more preferably 880° C. or lower), followed by cooling from the finishing temperature to the Ac1 point or lower, thereby forming a bainite or pearlite single-phase structure or a two-phase structure as containing ferrite.

After the above-mentioned hot rolling, annealing treatment is performed under conditions of holding at 600° C. to the Ac1 point (more preferably 610° C. to [Ac1-10° C.]) for 0.8 hours or longer (more preferably 1 hour or longer). By this annealing treatment, carbides are spheroidized and coarsened, and Mn is concentrated in the carbides to at least 1.1 times the amount of Mn added to the steel sheet. This annealing treatment may be performed by holding as such in the above-mentioned temperature region after cooling to the Ac1 point or lower, may be performed by gradual cooling in this temperature region, or may be performed after once cooled to lower than 600° C. after the hot rolling.

The Ac1 point can be determined from chemical components of the steel sheet using the following formula (1) described in Leslie, "The Physical Metallurgy of Steels", translated by Shigeyasu Kouda, Maruzen, 1985, p. 273.

$$Ac1\ (^\circ\ C.)=723-10.7\times Mn-16.9\times Ni+29.1\times Si+16.9\times Cr \quad (1)$$

Here, each element symbol in the above-mentioned formula represents the content (mass %) of each element.

After the above-mentioned annealed sheet is cold rolled, the cold-rolled sheet is subjected to heat treatment (γ-transformation heat treatment) under conditions of holding it at an austenite single-phase region temperature (the Ac3 point or higher) for 52 s or longer, thereby austenitizing the carbides. Since Mn has been concentrated in the carbides by the annealing treatment in the prior stage, austenite having a high Mn concentration is formed. By rapid cooling from the austenite single-phase region temperature to room temperature at a cooling rate of 100° C./s or more, residual austenite where Mn has been concentrated to at least 1.1 times the amount of Mn added to the steel sheet can be formed in martensite that is the matrix.

The Ac3 point can be determined from chemical components of the steel sheet using the following formula (2) described in Leslie, "The Physical Metallurgy of Steels", translated by Shigeyasu Kouda, Maruzen, 1985, p. 273.

$$Ac3\ (^\circ\ C.)=910-203\times\sqrt{C}-30\times Mn+44.7\times Si+700\times P+400\times Al-15.2\times Ni-11\times Cr-20\times Cu+400\times Ti+31.5\times Mo+104\times V \quad (2)$$

Here, each element symbol in the above-mentioned formula represents the content (mass %) of each element.

Then, tempered martensite is formed by tempering the above-mentioned heat-treated sheet under conditions of holding it at 150 to 300° C. for 30 to 1200 s, and strength-elongation balance can be improved to obtain the steel sheet in the present invention (the ultra-high-strength steel sheet excellent in the resistance to delayed fracture at the cut end).

In the present invention, the feature "excellent in the resistance to delayed fracture at the cut end" is judged by whether or not the delayed fracture occurrence ratio under the hydrochloric acid immersion condition of pH=1.0 is 50% or less, as described in Examples described later. This condition is intended for considerably severe delayed fracture environment even under actual environment, and when this condition is cleared, it means to have more extremely excellent resistance to delayed fracture at the cut end than the conventional steel sheet.

The present invention will be explained below in greater detail with reference to Examples, but it goes without saying that the present invention is not limited to the Examples described below and can be implemented with appropriate modifications without departing from the spirit described above and later, and all such modification are included in the technical scope of the present invention.

EXAMPLES

[Test Method]

Steels having respective compositions of A0 and A to L shown in Table 1 described below were melted, and ingots having a thickness of 120 mm were prepared. Using these ingots, hot rolling was performed to a thickness of 2.8 mm, and thereafter, annealing was performed under the annealing conditions shown in Table 2 described below. After the annealed sheets were pickled, they were cold rolled to a thickness of 1.0 mm to obtain cold-rolled sheets. Then, the cold-rolled sheets were subjected to γ-transformation heat treatment and tempering under the respective conditions shown in Table 2 described below.

TABLE 1

| Steel | Chemical Component* (mass %) | | | | | | | | Transformation temperature (° C.) | |
|---|---|---|---|---|---|---|---|---|---|---|
| type | C | Si | Mn | Al | P | S | N | Others | $Ac_1$ | $Ac_3$ |
| A0 | 0.25 | — | 1.67 | 0.045 | 0.010 | 0.0013 | 0.0042 | — | 734 | 782 |
| A | 0.21 | 1.81 | 1.05 | 0.045 | 0.008 | 0.0015 | 0.0041 | B: 0.002, Ti: 0.015 | 743 | 890 |
| B | 0.20 | 1.79 | 1.78 | 0.041 | 0.010 | 0.0016 | 0.0041 | — | 735 | 869 |
| C | 0.19 | 1.75 | 1.80 | 0.043 | 0.009 | 0.0012 | 0.0037 | Ca: 0.004, Mg: 0.005 | 735 | 869 |
| D | 0.25 | 0.52 | 1.08 | 0.046 | 0.008 | 0.0009 | 0.0041 | Ti: 0.05 | 741 | 823 |
| E | 0.10 | 1.42 | 1.10 | 0.046 | 0.008 | 0.0008 | 0.0038 | — | 742 | 900 |
| F | 0.23 | 1.35 | 0.48 | 0.045 | 0.008 | 0.0007 | 0.0035 | — | 748 | 882 |
| G | 0.22 | 1.47 | 0.91 | 0.046 | 0.008 | 0.0009 | 0.0041 | Cr: 0.50 | 752 | 893 |
| H | 0.21 | 1.53 | 1.12 | 0.045 | 0.008 | 0.0008 | 0.0042 | Cu: 0.10 | 742 | 874 |
| I | 0.21 | 1.62 | 1.16 | 0.046 | 0.009 | 0.0009 | 0.0041 | Ni: 0.10 | 740 | 877 |
| J | 0.22 | 1.53 | 1.02 | 0.045 | 0.008 | 0.0008 | 0.0037 | Nb: 0.05 | 743 | 875 |
| K | 0.21 | 1.53 | 0.98 | 0.043 | 0.008 | 0.0009 | 0.0041 | Mo: 0.10 | 743 | 919 |
| L | 0.19 | 1.46 | 1.11 | 0.043 | 0.008 | 0.0008 | 0.0037 | V: 0.05 | 742 | 881 |

(Underlined: outside the range of the present invention, *balance: iron and inevitable impurities, —: not added)

TABLE 2

| | | Annealing after hot rolling | | γ-transformation heat treatment | | | Tempering | |
|---|---|---|---|---|---|---|---|---|
| Production No. | Steel type | Temperature (° C.) | Time (h) | Temperature (° C.) | Time (s) | Cooling rate (° C./s) | Temperature (° C.) | Time (s) |
| 01 | A0 | 600 | 3 | 930 | 90 | >150 | 200 | 360 |
| 02 | A0 | 650 | 1 | 930 | 90 | >150 | 200 | 360 |
| 1 | A | 500 | 1 | 930 | 90 | >150 | 200 | 360 |
| 2 | A | 600 | 0.5 | 930 | 90 | >150 | 200 | 360 |
| 3 | A | 600 | 3 | 930 | 90 | >150 | 200 | 360 |
| 4 | A | 650 | 1 | 930 | 90 | >150 | 200 | 360 |
| 5 | A | 700 | 1 | 930 | 90 | >150 | 200 | 360 |
| 6 | A | 700 | 1 | 850 | 90 | >150 | 200 | 360 |
| 7 | A | 800 | 1 | 930 | 90 | >150 | 200 | 360 |
| 8 | B | 500 | 1 | 930 | 90 | >150 | 200 | 360 |
| 9 | B | 600 | 0.5 | 930 | 90 | >150 | 200 | 360 |

TABLE 2-continued

| Production No. | Steel type | Annealing after hot rolling Temperature (° C.) | Annealing after hot rolling Time (h) | γ-transformation heat treatment Temperature (° C.) | γ-transformation heat treatment Time (s) | γ-transformation heat treatment Cooling rate (° C./s) | Tempering Temperature (° C.) | Tempering Time (s) |
|---|---|---|---|---|---|---|---|---|
| 10 | B | 600 | 3 | 930 | 90 | >150 | 200 | 360 |
| 11 | B | 650 | 1 | 930 | 90 | >150 | 200 | 360 |
| 12 | B | 700 | 1 | 930 | 90 | >150 | 200 | 360 |
| 13 | B | 700 | 1 | 850 | 90 | >150 | 200 | 360 |
| 14 | B | 800 | 1 | 930 | 90 | >150 | 200 | 360 |
| 15 | C | 650 | 1 | 930 | 90 | >150 | 200 | 360 |
| 16 | D | 650 | 1 | 930 | 90 | >150 | 200 | 360 |
| 17 | E | 650 | 1 | 930 | 90 | >150 | 200 | 360 |
| 18 | F | 650 | 1 | 930 | 90 | >150 | 200 | 360 |
| 19 | G | 650 | 1 | 930 | 90 | >150 | 200 | 360 |
| 20 | H | 650 | 1 | 930 | 90 | >150 | 200 | 360 |
| 21 | I | 650 | 1 | 930 | 90 | >150 | 200 | 360 |
| 27 | J | 650 | 1 | 930 | 90 | >150 | 200 | 360 |
| 23 | K | 650 | 1 | 930 | 90 | >150 | 200 | 360 |
| 24 | L | 650 | 1 | 930 | 90 | >150 | 200 | 360 |

(Underlined: outside the range of the present invention, Hatched: outside the recommended conditions of the present invention)

[Measurement Methods]

Using each steel sheet obtained, the area ratio of martensite and residual austenite and the local Mn concentration were measured. In order to evaluate mechanical properties of the steel sheet, the tensile strength (TS) and the resistance to delayed fracture at the cut end were also measured. These measurement methods are shown below.

(Area Ratio of Martensite)

The area ratio of martensite was measured as follows. Each steel sheet was mirror polished, and a surface thereof was corroded with a 3% Nital liquid to expose a metal structure. Thereafter, using an SEM (scanning electron microscope), a structure of a portion of ¼ the sheet thickness was observed under a magnification of 2000 for 5 fields of view of an approximately 40 μm×30 μm region, and a region looking grey was defined as martensite. The area ratios determined for the respective fields of view were arithmetically averaged as the area ratio of martensite.

(Area Ratio of Residual Austenite)

The area ratio of residual austenite was determined by grinding and polishing each steel sheet to ¼ the sheet thickness in a sheet thickness direction and measuring X-ray diffraction intensity.

(Local Mn Concentration)

The local Mn concentration was determined by quantitatively analyzing 3 fields of view of an approximately 20 μm×20 mm region using a field emission electron probe microanalyzer (FE-EPMA), dividing a measurement region to small regions of 1 μm×1 μm in each field of view, and averaging the Mn concentrations in the respective small regions. The ratio of small regions where the average Mn concentration is at least 1.1 times the Mn content in the steel sheet was defined as the area ratio of the Mn-concentrated region in each field of view, and calculated. Evaluation was performed by arithmetically averaging the area ratios of the Mn-concentrated regions in the 3 fields of view.

(Tensile Strength)

Using each steel sheet to be evaluated, a No. 5 testpiece described in JIS Z 2201 was prepared while taking a major axis to a direction perpendicular to a rolling direction, and measurement was performed in accordance with JIS Z 2241 to determine the tensile strength (TS).

(Resistance to Delayed Fracture at Cut End)

For each steel sheet, 3 steel sheets each having a cut end surface were prepared by performing shear cutting as shown in FIG. 1 to plate-like steel sheets having a thickness of 1.0 mm. The sheets were cut to a size of 50 mm×30 mm×1.0 mm thick so that the cut end surface had a width of 50 mm. The cutting clearance was 10% of the sheet thickness. The evaluation of the resistance to delayed fracture was performed at the cut end surface on the free end side shown in FIG. 1. Since the free end side is cut in a state where the steel sheet is not restrained, it is a site where delayed fracture easily occurs compared with the fixed end side. More specifically, a hydrochloric acid immersion test was performed under conditions of immersing the steel sheet having the above-mentioned cut end surface in hydrochloric acid controlled to a pH of 1.0 and a liquid temperature of 25° C. for 24 hours. After the hydrochloric acid immersion test was performed, each steel sheet was divided into 10 sheets each having a size of 5 mm×30 mm×1.0 mm thick, and then, each of them was mirror polished, in order to observe a sheet thickness cross section orthogonal to the cut end surface of the steel sheet. For these 30 cross sections, the presence or absence of delayed fracture was confirmed using an optical microscope, and "((the number of cross sections in which the delayed fracture was observed)/30)×100%" was defined as the delayed fracture occurrence ratio. In order to distinguish between a fine crack which occurred by cutting and a crack caused by the delayed fracture, a crack having a depth of 50 μm or more from the cut end surface was determined as the delayed fracture.

[Measurement Results]

The measurement results are shown in Table 3 described below. In these examples, the sheet having a tensile strength (TS) of 1470 MPa or more and a delayed fracture occurrence ratio of 50% or less was represented by "A" and evaluated as passed, and determined as an ultra-high-strength steel sheet excellent in the resistance to delayed fracture at the cut end. On the other hand, the sheet having a tensile strength (TS) of less than 1470 MPa or a delayed fracture occurrence ratio of more than 50% was represented by "B" and determined as failed.

TABLE 3

| Steel No. | Steel type | Production No. | Area ratio in structure (%) Martensite | Area ratio in structure (%) Residual γ | Area ratio in structure (%) Mn-concentrated region | Mechanical properties TS (MPa) | Mechanical properties Delayed fracture occurrence ratio (%) | Evaluation |
|---|---|---|---|---|---|---|---|---|
| 01 | A0 | 01 | 99 | 0.7 | 5.8 | 1515 | 50 | A |
| 02 | A0 | 02 | 99 | 0.7 | 6.8 | 1513 | 49 | A |
| 1 | A | 1 | 95 | 0.9 | 0.5 | 1528 | 80 | B |
| 2 | A | 2 | 95 | 1.1 | 1.2 | 1531 | 65 | B |
| 3 | A | 3 | 95 | 1.1 | 3.2 | 1523 | 40 | A |
| 4 | A | 4 | 94 | 1.0 | 4.4 | 1518 | 33 | A |
| 5 | A | 5 | 95 | 0.7 | 5.8 | 1508 | 13 | A |
| 6 | A | 6 | 78 | 1.5 | 8.5 | 1354 | 7 | B |
| 7 | A | 7 | 94 | 1.2 | 0.8 | 1498 | 67 | B |
| 8 | B | 8 | 97 | 1.1 | 0.7 | 1554 | 87 | B |
| 9 | B | 9 | 96 | 1.2 | 1.4 | 1564 | 60 | B |
| 10 | B | 10 | 96 | 1.2 | 3.3 | 1535 | 43 | A |
| 11 | B | 11 | 95 | 1.1 | 4.9 | 1533 | 40 | A |
| 12 | B | 12 | 97 | 0.8 | 6.3 | 1525 | 17 | A |
| 13 | B | 13 | 83 | 1.6 | 9.1 | 1389 | 3 | B |
| 14 | B | 14 | 95 | 1.2 | 1.2 | 1511 | 70 | B |
| 15 | C | 15 | 99 | 1.0 | 4.8 | 1564 | 25 | A |
| 16 | D | 16 | 98 | 0.7 | 5.2 | 1506 | 42 | A |
| 17 | E | 17 | 35 | 0.0 | 2.1 | 858 | 0 | B |
| 18 | F | 18 | 82 | 0.3 | 4.5 | 1258 | 0 | B |
| 19 | G | 19 | 99 | 0.9 | 4.2 | 1535 | 35 | A |

TABLE 3-continued

| Steel No. | Steel type | Production No. | Area ratio in structure (%) Martensite | Residual γ | Mn-concentrated region | Mechanical properties TS (MPa) | Delayed fracture occurrence ratio (%) | Evaluation |
|---|---|---|---|---|---|---|---|---|
| 20 | H | 20 | 98 | 1.2 | 5.1 | 1524 | 10 | A |
| 21 | I | 21 | 99 | 1.0 | 3.6 | 1545 | 13 | A |
| 22 | J | 22 | 98 | 1.1 | 4.1 | 1568 | 7 | A |
| 23 | K | 23 | 98 | 1.1 | 3.8 | 1587 | 33 | A |
| 24 | L | 24 | 99 | 1.0 | 4.5 | 1552 | 23 | A |

(Underlined: outside the range of the present invention, Hatched: outside the recommended conditions of the present invention)

As shown in Table 3, all the invention steels (steel Nos. 01, 02, 3 to 5, 10 to 12, 15, 16 and 19 to 24) fulfilling the requirements of the present invention (the above-mentioned component requirements and the above-mentioned structure requirements) satisfy a tensile strength TS of 1470 MPa or more and a delayed fracture occurrence ratio of 50% or less, and the ultra-high-strength steel sheets excellent in the resistance to delayed fracture at the cut end have been obtained.

By contrast, the comparative steels (steel Nos. 1, 2, 6 to 9, 13, 14, 17 and 18) not satisfying at least one of the requirements of the present invention (the above-mentioned component requirements and the above-mentioned structure requirements) are degraded in at least either one property of the tensile strength TS and the delayed fracture occurrence ratio.

For example, in steel Nos. 1 and 8, the annealing temperature after hot rolling is too low and is outside the recommended range as shown in production Nos. 1 and 8 of Table 2, respectively. Thus, Mn is not sufficiently concentrated in residual austenite to degrade the resistance to delayed fracture at the cut end, as shown in Table 3.

On the other hand, in steel Nos. 7 and 14, the annealing temperature after hot rolling is too high and is outside the recommended range as shown in production Nos. 7 and 14 of Table 2, respectively. Thus, Mn is homogenized by diffusion, and Mn is not sufficiently concentrated in residual austenite to degrade the resistance to delayed fracture at the cut end, as shown in Table 3.

Further, in steel Nos. 2 and 9, the annealing bolding time after hot rolling is too short and is outside the recommended range as shown in production Nos. 2 and 9 of Table 2, respectively. Thus, Mn is not sufficiently concentrated in residual austenite to degrade the resistance to delayed fracture at the cut end, as shown in Table 3.

In addition, in steel Nos. 6 and 13, the γ-transformation heat treatment temperature is too low and is outside the recommended range as shown in production Nos. 6 and 13 of Table 2. Thus, austenitization is not sufficiently achieved, and martensite is insufficient, resulting in poor tensile strength TS, as shown in Table 3.

Furthermore, in steel No. 17, the C content is too low as shown in steel type E of Table 1. Thus, both martensite and residual austenite are insufficient, resulting in poor tensile strength TS, as shown in Table 3.

Further, in steel No. 18, the Mn content is too low as shown in steel type F of Table 1. Thus, both martensite and residual austenite are insufficient, resulting in poor tensile strength TS, as shown in Table 3.

As described above, it has been confirmed that the ultra-high-strength steel sheets excellent in the resistance to delayed fracture at the cut end are obtained by satisfying the requirements of the present invention.

While the present invention has been described in detail and with reference to specific embodiments thereof, it will be apparent to one skilled in the art that various changes and modifications can be made therein without departing from the spirit and scope thereof.

This application is based on Japanese Patent Application No. 2015-026735 filed on Feb. 13, 2015 and Japanese Patent Application No. 2015-147463 filed on Jul. 27, 2015, the entire subject matters of which are incorporated herein by reference.

INDUSTRIAL APPLICABILITY

The ultra-high-strength steel sheet of the present invention is excellent in resistance to delayed fracture at the cut end, and is useful as steel sheets for automobiles such as cold-rolled steel sheets and various plated steel sheets.

The invention claim is:

1. A steel sheet comprising, by mass %,
C: 0.15% to 0.4%,
Mn: 0.5% to 3.0%,
Al: 0.001% to 0.10%, and
iron and inevitable impurities,
wherein:
each of P, S and N of the inevitable impurities is limited to
P: 0.1% or less
S: 0.01% or less and
N: 0.01% or less,
the steel sheet has a structure comprising, by area ratio based on a whole structure,
martensite: 90% or more, and
residual austenite: 0.5% or more,
the steel sheet has 2% or more by area ratio of a region where a local Mn concentration is at least 1.1 times a Mn content in a whole steel sheet, and
the steel sheet has a tensile strength of 1470 MPa or more.

2. The steel sheet according to claim 1, further comprising, by mass %, at least one of the following (a) to (d):
(a) Si: 0.1% to 3.0%,
(b) one or two or more of Cu: 0.05% to 1.0%, Ni: 0.05% to 1.0% and B: 0.0002% to 0.0050%,
(c) one or two or more of Mo: 0.01% to 1.0%, Cr: 0.01%, to 1.0%, Nb: 0.01% to 0.3%, Ti: 0.01% to 0.3% and V: 0.01% to 0.3%, and
(d) one or two of Ca: 0.0005% to 0.01% and Mg: 0.0005% to 0.01%.

3. The steel sheet according to claim 1, which does not contain Si.

4. The steel sheet according to claim 1, which does not contain Ti.

5. The steel sheet according to claim 1, which does not contain Cu.

6. The steel sheet according to claim 1, wherein the structure of the steel sheet contains phases other than martensite and residual austenite in a total area ratio of 9.5% or less.

* * * * *